US005368533A

United States Patent [19]

Feuer et al.

[11] Patent Number: 5,368,533

[45] Date of Patent: Nov. 29, 1994

[54] QUADRILATERAL EXERCISE APPARATUS

[75] Inventors: Mark S. Feuer; Fred W. Kreiner; Howard J. Solow; Michael H. Harding, all of Boulder, Colo.

[73] Assignee: Fittraxx, Boulder, Colo.

[21] Appl. No.: 61,493

[22] Filed: May 13, 1993

[51] Int. Cl.[5] ..... A63B 23/00; A63B 21/00

[52] U.S. Cl. ..... 482/70; 482/51; 482/134

[58] Field of Search ..... 482/70, 51, 71, 52, 482/5, 8, 125, 110

[56] References Cited

U.S. PATENT DOCUMENTS

| | | | |
|---|---|---|---|
| 219,139 | 2/1879 | Blend . | |
| 219,437 | 9/1879 | Bennett . | |
| 1,016,729 | 2/1912 | Barrett . | |
| 2,646,282 | 7/1953 | Ringman . | |
| 2,969,060 | 1/1961 | Swanda et al. . | |
| 3,213,852 | 10/1965 | Zent . | |
| 3,363,335 | 1/1968 | Burhns et al. . | |
| 3,582,069 | 6/1971 | Flick et al. . | |
| 3,940,128 | 2/1976 | Ragone . | |
| 3,941,377 | 3/1976 | Lie . | |
| 4,023,795 | 5/1977 | Pauls . | |
| 4,402,506 | 9/1983 | Jones . | |
| 4,434,981 | 3/1984 | Norton . | |
| 4,512,571 | 4/1985 | Hermelin . | |
| 4,529,194 | 7/1985 | Haaheim . | |
| 4,618,139 | 10/1986 | Haaheim . | |
| 4,632,385 | 12/1986 | Geraci . | |
| 4,659,077 | 4/1987 | Stropkay | 482/70 |
| 4,679,786 | 7/1987 | Rodgers . | |
| 4,709,918 | 12/1987 | Grinblat | 482/70 |
| 4,714,244 | 12/1987 | Kolomayets et al. . | |
| 4,743,015 | 5/1988 | Marshall . | |
| 4,798,379 | 1/1989 | Jenkins . | |
| 4,842,265 | 6/1989 | Kirk . | |
| 4,867,443 | 9/1989 | Jensen . | |
| 4,900,013 | 2/1990 | Rodgers, Jr. . | |
| 4,948,121 | 8/1990 | Hermelin . | |
| 4,960,276 | 10/1990 | Feuer et al. | 482/70 |
| 4,979,731 | 12/1990 | Hermelin . | |
| 5,192,257 | 3/1993 | Panasewicz | 482/134 |

FOREIGN PATENT DOCUMENTS

| | | |
|---|---|---|
| 490720 | 2/1953 | Canada . |
| 2411365 | 9/1975 | Germany . |
| 331825 | 7/1930 | United Kingdom . |
| 560622 | 7/1980 | U.S.S.R. . |
| 1049071 | 9/1982 | U.S.S.R. . |
| 1251935 | 3/1985 | U.S.S.R. . |

*Primary Examiner*—Stephen R. Crow
*Attorney, Agent, or Firm*—Gary M. Polumbus

[57] ABSTRACT

A quadrilateral exercise and training device includes a plurality of longitudinally extending channel members mounted on cross frame members so as to define elongated slots in which foot-supporting members and hand-engaging members can reciprocate. A control system interconnecting the foot-supporting members and hand-engaging members includes a main flat synchronizing belt interconnecting the foot-supporting members and hand-engaging members to establish desired coordination between the respective members, a safety belt interconnecting the foot-supporting members and a drive belt associated with each foot-supporting member which operatively engage a pair of drive shafts having a braking system and an optical transducer for converting rotation of one of the drive shafts to a digitized informational readout for use by an operator.

10 Claims, 8 Drawing Sheets

QUADRILATERAL EXERCISE APPARATUS

BACKGROUND OF THE INVENTION

1. Field of the Invention

The present invention relates generally to training and exercise apparatus and more particularly to a quadrilateral training and exercise apparatus adapted to simulate cross-country skiing.

2. Description of the Prior Art

While many types of devices and apparatus have been developed and used through the years for assisting an individual in obtaining desired exercise and particularly cardiovascular exercise, it has only been in recent years that the importance of such exercise has been fully appreciated. The exercise can also form the basis for training for a particular athletic endeavor. As a result, numerous types of equipment have been developed to exercise various parts of the body. In some cases, the equipment is designed to develop muscular strength, but in other types of equipment, the goal is directed more to cardiovascular benefits, and such exercise equipment is commonly referred to as aerobic exercise equipment.

Most exercise specialists acknowledge that cross-country skiing is one of the best forms of aerobic exercise and that both the arms and the legs are utilized, thereby more quickly obtaining an elevated heart rate while obtaining and maintaining good muscle tone throughout the body. For this reason, many types of equipment have been developed in an attempt to simulate cross-country skiing so that cross-country skiing movements can be performed in an indoor environment.

There have been numerous cross-country ski simulating apparatus developed for indoor use such as, for example, those illustrated in U.S. Pat. No. 4,659,077 to Stropkay and U.S. Pat. No. 4,434,981 to Norton. The devices disclosed in these two patents include a pair of foot support platforms adapted to guide the feet in a linear reciprocatory manner while independent hand manipulated means are provided for simulating movement of ski poles. In each device, however, there is no operative connection between the foot and hand movements and for that reason the devices have proven difficult to use. Due to the difficulty of coordinating the hand and foot movements, individuals will spend hours and sometimes days trying to learn how to use such an apparatus and in many cases where the apparatus is located in a public exercise facility, the embarrassment will prevent an individual from continuing to use the apparatus.

To avoid the shortcomings of the apparatus disclosed in the Stropkay and Norton patents, cross-country ski exercise apparatus have been developed wherein the movements of the feet and arms are coordinated by mechanical linkage so that as one foot moves rearwardly, the associated hand moves forwardly at the same speed. In fact, in some of these apparatus, foot-supporting platforms themselves are mechanically linked so that as one foot moves rearwardly the other foot moves forwardly. Examples of such apparatus are shown in U.S. Pat. No. 4,679,786 issued to Rogers and Canadian Patent No. 490,720 issued to Denison. While the apparatus disclosed in these patents overcome the coordination problems inherent in the patents to Stropkay and Norton, it will be appreciated that the exercise motion provided by a device wherein the arms and legs are operatively interconnected for simultaneous movement at equivalent speeds is biomechanically incorrect and awkward and thus will create a very jerky motion which is not necessarily enjoyable and is difficult to maintain over a long period of time. Further, the jerking movement might cause physiological damage which is not caused by the smooth fluid motion obtained in natural cross-country skiing.

It was to overcome the shortcomings in the aforenoted prior art that the apparatus disclosed in U.S. Pat. No. 4,960,276 issued to Feuer, et al. and the apparatus disclosed in pending U.S. application Ser. No. 07,728,188 filed Jul. 10, 1991 under the name of Panasewicz were developed. The Feuer patent and Panasewicz application are of common ownership with the present application. The apparatus disclosed in the Feuer patent and the Panasewicz application include means for allowing hand-engaging members to move approximately twice as fast as foot-engaging supports so that relative movement between the hand-engaging members and the foot-supporting members more closely resembles actual cross-country skiing.

As will be appreciated from a review of the prior art, it can be seen that in order to desirably simulate cross-country skiing, a fairly complex system needs to be employed which can include numerous gears, cables, flywheels and the like. Some systems are so complex they are readily amenable to breakage or malfunction. Further, some systems have so many interconnected gears or the like that the internal resistance to operation renders them difficult to operate in a manner that provides light exercise. It is to overcome the shortcomings in the prior art devices and to produce an apparatus that closely resembles cross-country skiing for both exercise and training purposes that the present invention has been developed.

SUMMARY OF THE INVENTION

The quadrilateral exercise and training apparatus of the present invention has been designed with simplicity in mind and is adapted to work all four extremities in obtaining optimal cardiovascular exercise. The apparatus has been designed to closely simulate cross-country skiing for both exercise and training purposes. It can be operated continuously over long periods of time and allows for variable resistance to permit very light to very heavy levels of exercise.

The framework for the apparatus consists of a plurality of longitudinally extending channel members that are interconnected so as to define a horizontal platform on which an individual obtains the desired exercise and training. A pair of foot-supporting members and a pair of hand-engaging members are mounted for linear reciprocating movement between the channels and a control system interconnects the foot-supporting members and hand-engaging members to coordinate relative movement. Associated hands and feet of a user are moved in opposite directions with the hands moving at approximately twice the speed of the feet so as to accurately simulate cross-country skiing.

The foot-supporting members include roller mounted trolleys as do the hand-engaging members with the trolleys having rollers that are mounted in mutually perpendicular relationship to each other so as to support the trolleys not only vertically but also horizontally to accommodate various stresses placed thereon while accommodating easy rolling movement along the channels in the framework. The apparatus further includes a restraint device which is adjustably adapted to pass around a user's waist to retain the user in a selected position on the apparatus.

The control system has been uniquely designed to incorporate a minimal number of moving component parts so that it is less susceptible to damage. There is also minimal weight and resistance in the control system to permit the apparatus to be used for very light exercise.

The control system includes a main flat synchronizing belt interconnecting the foot-supporting members and hand-engaging members through a plurality of idler pulleys mounted on the framework so that movement of the foot-supporting platforms are in opposite directions and are coordinated with the hand-engaging members. The movement is such that associated foot-supporting members and hand-engaging members are also reciprocated in opposite directions with the hand-engaging members moving at approximately twice the speed of the foot-supporting members. A pair of endless drive belts are connected to each foot-supporting member and to a first drive shaft having a pair of one-way clutches thereon which drive shaft is in turn interconnected by a belt to a second drive shaft having an electronic braking system with an inertial weight as a part thereof. The electronic braking system serves to selectively resist rotative movement of the second drive shaft thereby operatively resisting movement of the foot-supporting members and hand-engaging members. The second drive shaft also includes a transducer for converting the rotating speed of the second drive shaft to a digitized readout for advising a user of the apparatus of his relative ground speed. The control system further includes a safety or coordination belt interconnecting each foot-supporting member via a pair of idler pulleys on the framework to prevent injury to a user in the event either drive belt were to break for any reason. The safety and coordination belt also assists the synchronizing belt by coordinating movement of the feet.

It will be appreciated from the following detailed description that the control system is very simple in structure and operation while providing all of the controls necessary for an efficient and dependable apparatus and providing feedback to its user regarding exercise difficulty levels and the like. It will also be appreciated that due to the simplicity of the apparatus and particularly the control system, there is very little frictional resistance in the system to be overcome by a user of the apparatus so very light levels of exercise can be obtained if desired. Further, the control system is such that either arms or legs or both arms and legs are utilized in either pushing or pulling or both motions to obtain the use of the maximum number of muscle groups.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
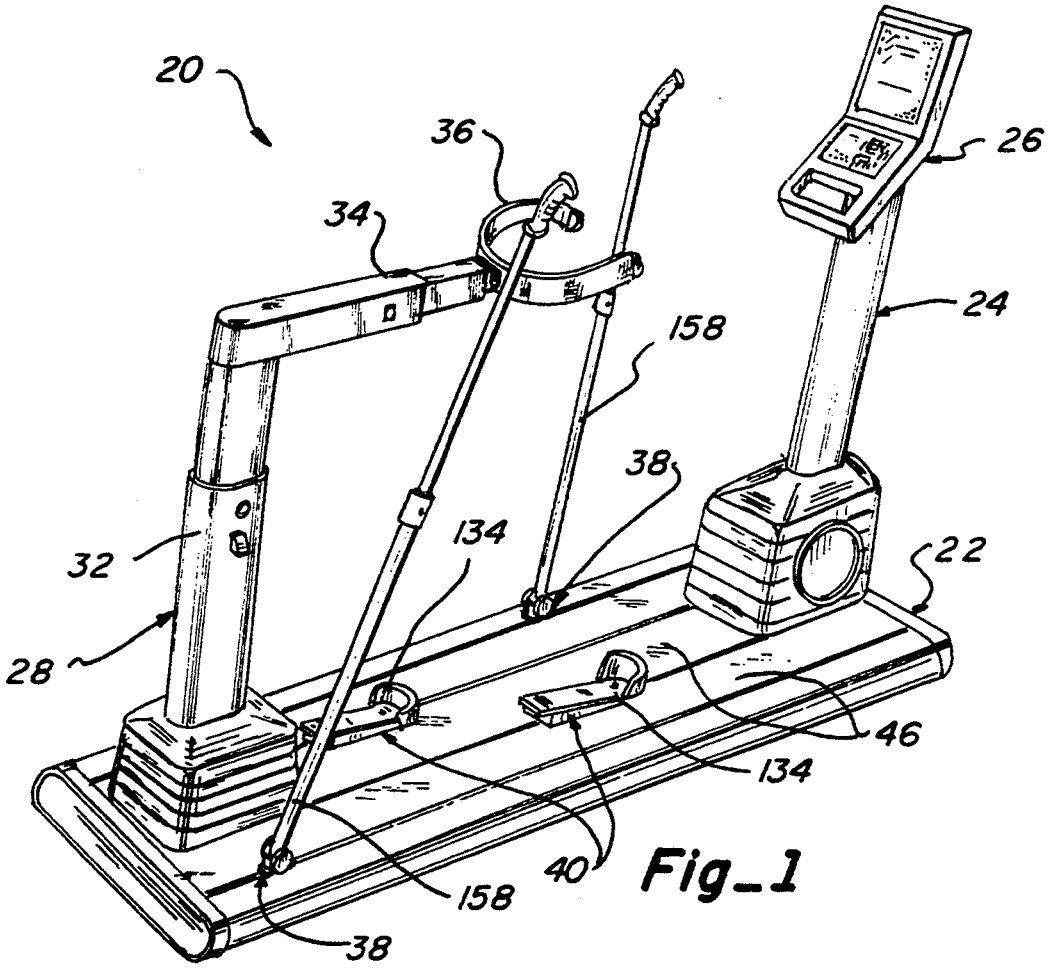
FIG. 1 is an isometric view of the apparatus of the present invention.
Figure 2:
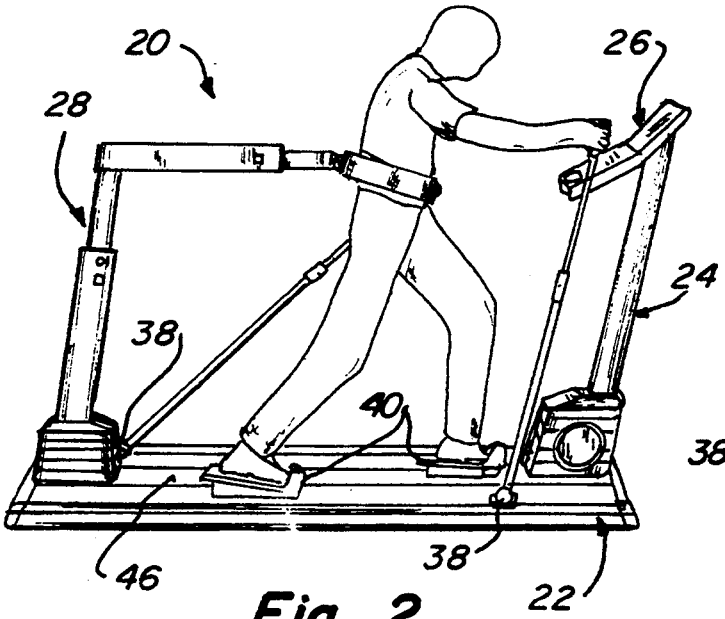
FIG. 2 is an isometric view of the apparatus taken from a slightly different angle than that of FIG. 1 and showing an individual using the apparatus.

The quadrilateral exercise apparatus 20 of the present invention is seen in FIGS. 1 and 2 to include a base platform 22, an upright standard 24 at the forward end of the platform upon which an electronic control and display device 26 is positioned and an adjustable upright restraining system 28 at the rear end of the platform. The electronic control and display device includes conventional state of the art electronics for controlling the level of exercise desired from the apparatus and for displaying hypothetical ground speeds of operation of the apparatus, estimations of hypothetical distance covered, heart rate monitoring, energy expenditure, and other forms of cardiovascular information known in the art.

The upright restraining system 28 at the rear end of the platform has a horizontal rear base plate 30 (FIGS. 4 and 8) to which a substantially vertical segment 32 of the restraining system is mounted. The vertical segment is adjustable in length in a conventional manner as is a horizontal segment 34 which also forms a part of the restraining system. The terminal forward end of the horizontal segment 34 carries a belt 36 which is adapted to extend around the waist of a user of the apparatus. The vertical adjustment is provided to accommodate various sized individuals so that when using the apparatus an individual is comfortable. The horizontal adjustment is to control the forward lean of the user which determines the magnitude of hip and knee flexion during exercise.

A pair of hand-engaging members 38 and foot supporting members 40 are reciprocally disposed in the base platform 22. The hand-engaging members and foot supporting members are operatively interconnected by a control system, also disposed in the base platform, for coordinated movement that simulates cross-country skiing.

With reference to FIGS. 4 through 6, 8, 13 and 14, the base platform 22 can be seen to include a framework of longitudinally extending spaced channel extrusions which are welded or otherwise fastened to a plurality of transversely extending cross frame members 44. A multi-piece cover sheet 46, as seen best in FIGS. 1–3, 9, and 16, overlies the framework to help enclose most of the working components of the apparatus and give the apparatus an aesthetically pleasing appearance.

Figure 15:
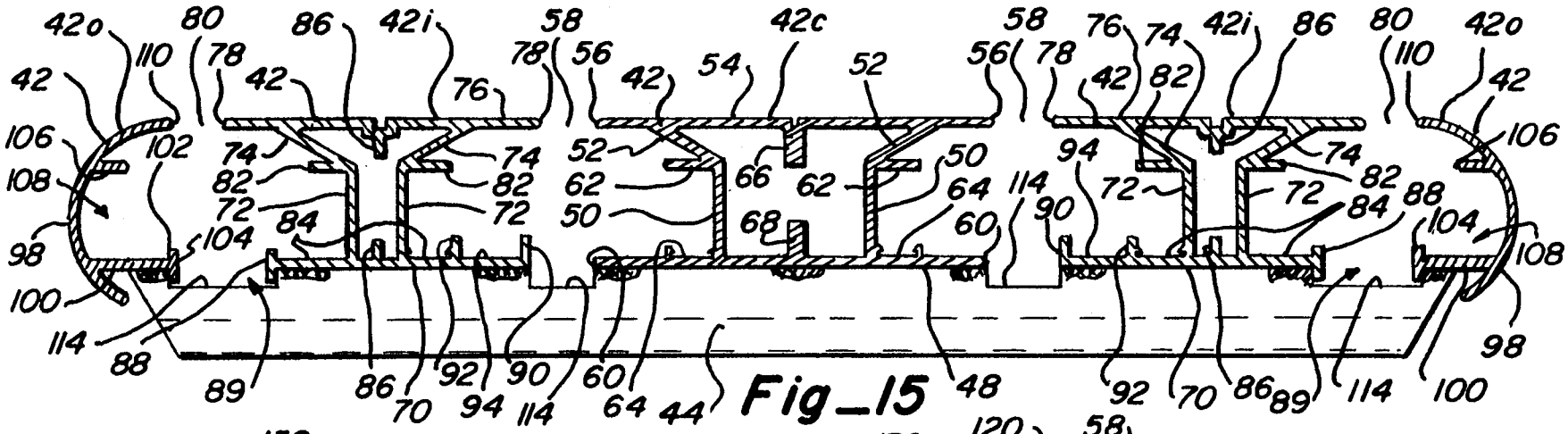
FIG. 15 is a transverse section taken through the framework with only the extrusion members and a cross frame member being illustrated.

As probably best illustrated in FIG. 15, there are five longitudinally extending channel extrusion members 42 of three different cross-sectional configurations. There is one central extrusion **42*c*, two intermediate extrusions 42*i* on either side of the central extrusion, and two outer extrusions 42*o* on either side of the intermediate extrusions. The central extrusion 42*c* can be seen in cross-section to include a bottom wall 48 and a pair of parallel vertically oriented side walls 50 which extend perpendicularly to the bottom wall. Outwardly divergent side wall extensions 52 extend from the top of each side wall to a horizontal top wall segment 54 of the extrusion. The lateral edges 56 of the top wall segment 54 are spaced from the adjacent intermediate extrusions 42*i* so as to define open slots 58 therebetween to accommodate movement of the foot-supporting members 40 in a manner to be described in more detail later. Similarly, the bottom wall 48 of the central extrusion member 42*c* has lateral edges 60** which are spaced from the adjacent intermediate extrusions for reasons that will become more clear later.

At each juncture of the side walls 50 with the outwardly divergent side wall extensions 52, a horizontal outwardly directed wall segment 62 is integrally formed so as to cooperate with the side walls 50 and the bottom wall 48 in defining a track 64 that cooperates with a foot-supporting member 40 in guiding its reciprocatory longitudinal movement along the framework. The central extrusion also includes a centrally disposed web 66 depending from the top wall segment and an upstanding web 68 from the bottom wall for reinforcement and structural purposes.

The intermediate extrusions **42*i* are identical and can be seen in cross-section to include a bottom wall 70 and a pair of parallel vertically oriented side walls 72 projecting upwardly from the bottom wall at a location that is offset slightly laterally outwardly from a centered position. Outwardly divergent side wall extensions 74 extend from the top of each side wall 72 to a horizontal top wall segment 76 of the extrusion. The lateral edges 78 of the top wall segment are spaced from the adjacent central extrusion 42 and the outer extrusion 42*o* so as to define the open slots 58 and other open slots 80 respectively to accommodate movement of the foot-supporting members 40 and the hand-engaging members 38, respectively. At each juncture of a side wall 72 with its associated side wall extension 74, a horizontal wall segment 82 is provided and cooperates with the associated side wall and the bottom wall 70 in defining tracks 84 to accommodate and guide movement of either a foot-supporting member or a hand-engaging member in a manner to be described later. Reinforcing webs 86 which are equally spaced between the side walls depend from the top wall and project upwardly from the bottom wall for structural purposes. The bottom wall 70 further includes along its outer edge a perpendicular plate 88 that extends a short distance above and below the bottom wall and partially defines a track 89 for guiding movement of a hand-engaging member. At the opposite end of the bottom wall 70 and along an inner side edge thereof, an upstanding rib 90 is provided in a perpendicular orientation to the bottom wall with the rib 90 being spaced from a second upstanding rib 92 so as to define a track 94** therebetween to assist in guiding movement of a foot-supporting member. The purpose for the tracks will become more clear with the description that follows.

The outer extrusions **42*o* in cross section can be seen to include an arcuate side wall 98 which is substantially semi-cylindrical in configuration having a horizontal bottom wall 100 projecting inwardly from the concave surface of the side wall. The inner edge 102 of the bottom wall has a perpendicular plate 104 extending slightly above and below the bottom wall in confronting relationship with the comparable plate 88 on the intermediate extrusions. The plates 88 and 104 define therebetween the track 89 for guiding movement of a hand-engaging member. A horizontal inwardly extending upper wall 106 is spaced above the bottom wall 100 and cooperates with the arcuate side wall 98 and the bottom wall in defining a vertical track 108 that serves to facilitate and guide movement of a hand-engaging member 38 along the framework as will become more clear later. It will also be appreciated by reference to FIG. 15 that the upper edge 110 of the arcuate side wall is spaced from the adjacent side edge 78 of the upper wall segment 76 of an intermediate extrusion 42*i* to define the longitudinally extending slot 80** through which a hand-engaging member can protrude.

As best seen in FIG. 15, the cross frame members 44 to which the channel extrusions are welded, are notched at a plurality of spaced locations 114 along the top edge thereof in alignment with the spaces defined between the bottom walls of the adjacent extrusions 42. The notches serve various functions which will become more clear hereafter.

Figure 16:
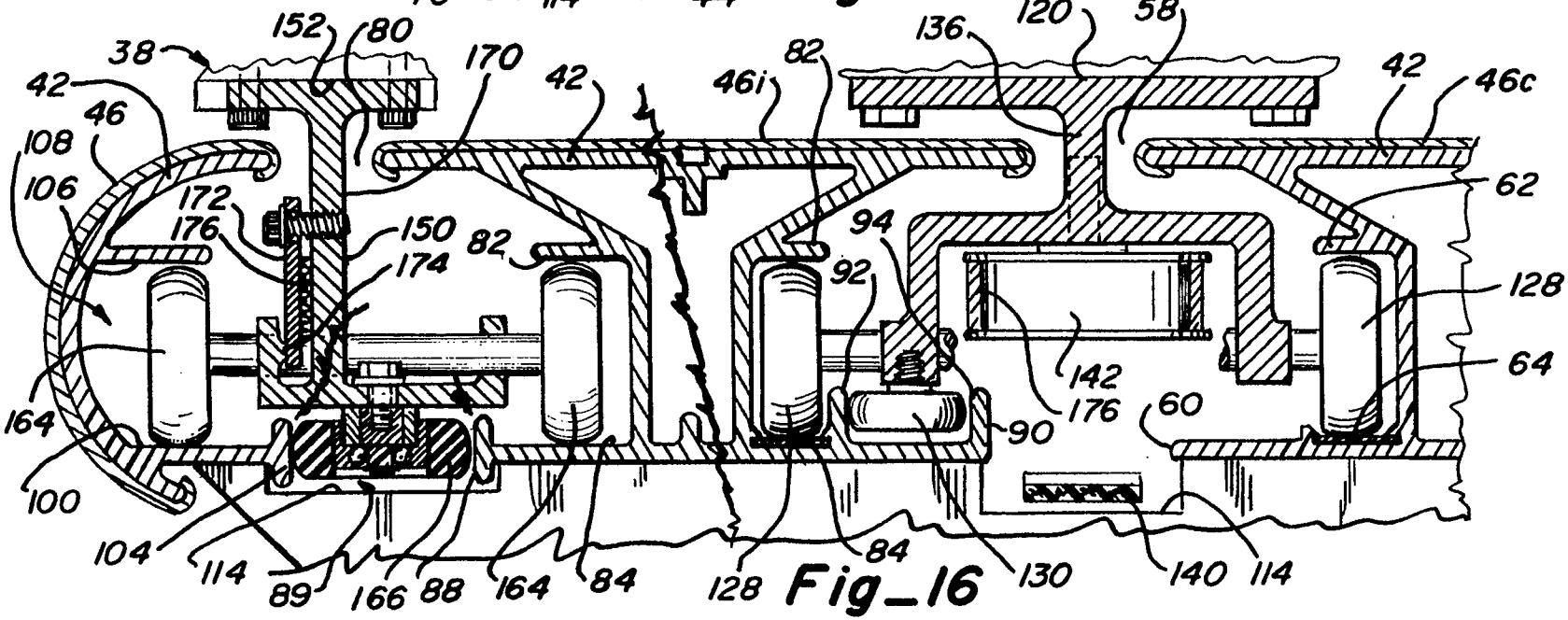
FIG. 16 is a fragmentary transverse section taken along line 16—16 of FIG. 4.

As can be appreciated, when the five horizontally adjacent channel extrusion members 42 are interconnected as shown in FIG. 15, they define a portion of the framework for the base platform 22 and are sized and configured to receive the various component parts of the cover sheet or shell 46. The cover sheet itself includes components as best seen in FIGS. 1, 9 and 16 to cover the semi-arcuate side wall 98 of each outer channel extrusion member **42*o*, the top walls of the central and intermediate channel extrusion members 42*c* and 42*i*** respectively and the terminal ends of the outer and intermediate extrusion members.

Figure 4:
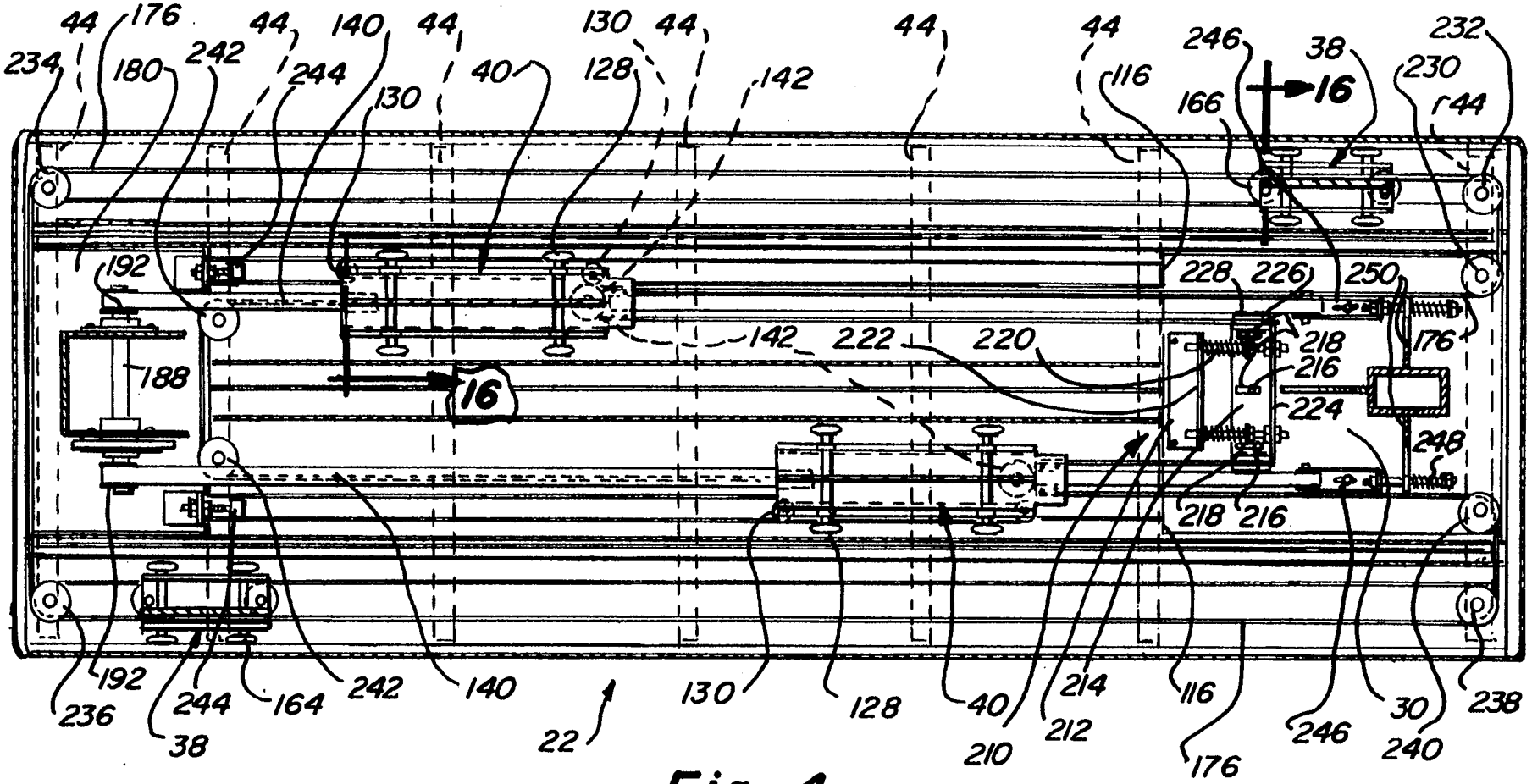
FIG. 4 is a enlarged section taken along line 4—4 of FIG. 3.

As can be appreciated from FIG. 4, the central channel extrusion member **42*c* is shorter in length than the outer extrusion members 42*o* thereby establishing a space within the framework at each end of the apparatus to receive other working components of the apparatus. The intermediate channel extrusion members 42*i* are severed in half longitudinally from each end for a short distance to further broaden the spaces within the framework which accommodate the other working components. In other words, each intermediate channel extrusion member has a notch 116 formed along an inner side edge at each end with each notch terminating at a location adjacent to an associated end of the central channel extrusion 42*c*. For structural integrity and as a means of securing working components of the system to the framework, the cross frame members 44 are mounted beneath the channel extrusions 42** at spaced locations along the length of the apparatus and secured to the channel extrusions in any suitable manner such as by welding. The cross frame members are preferably of U-shaped cross section.

Figures 8, 9, 10:
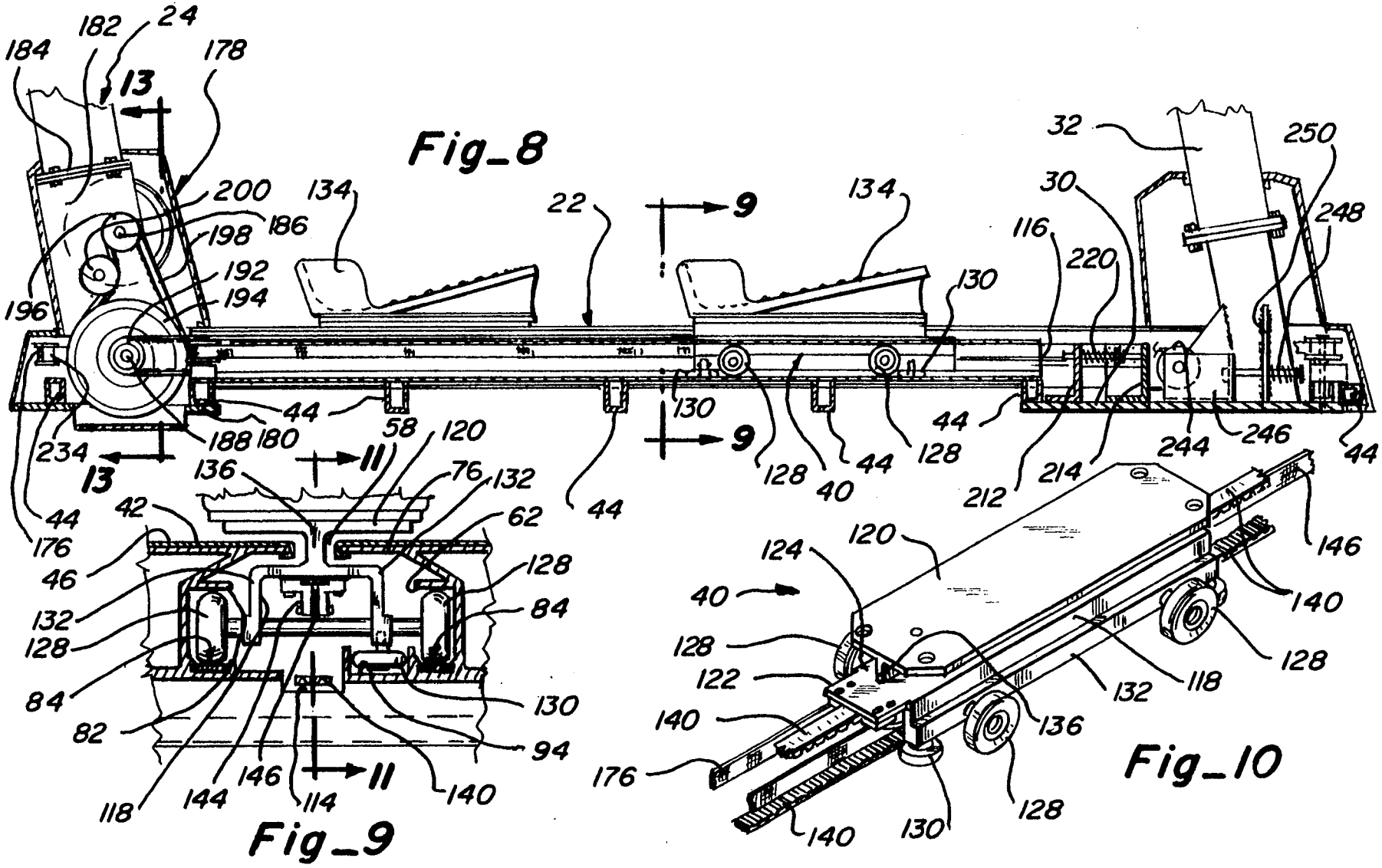
FIG. 8 is an enlarged section taken along line 8—8 of FIG. 3 with parts removed for size consideration.
FIG. 9 is an enlarged fragmentary section taken along line 9—9 of FIG. 8.
FIG. 10 is a fragmentary isometric view of a portion of the trolley of a foot-supporting platform.
Figure 11:
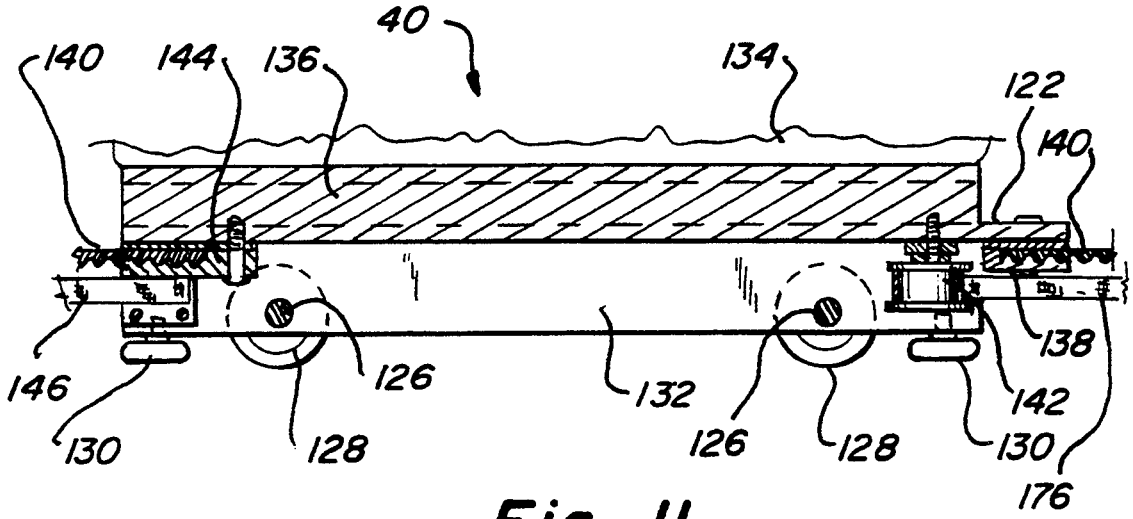
FIG. 11 is an enlarged fragmentary section taken along line 11—11 of FIG. 9 of the foot trolley.
Figure 12:
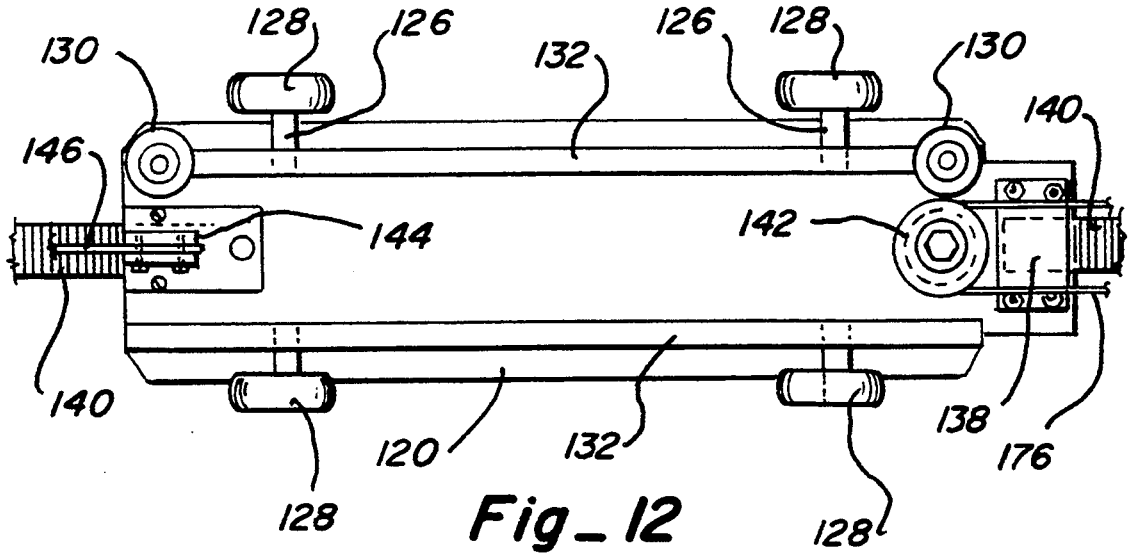
FIG. 12 is a bottom plan view of the foot trolley shown in FIG. 11.
Figure 13:
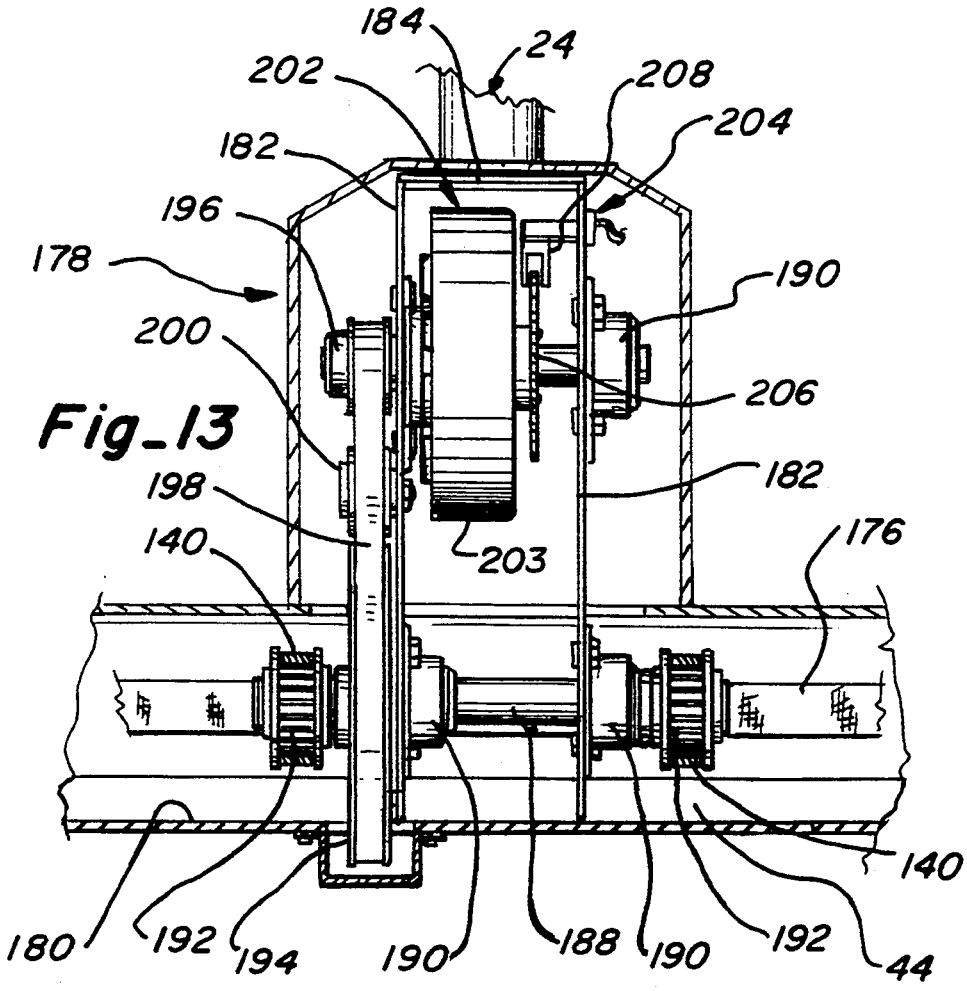
FIG. 13 is a section taken along line 13—13 of FIG. 8.
Figure 14:
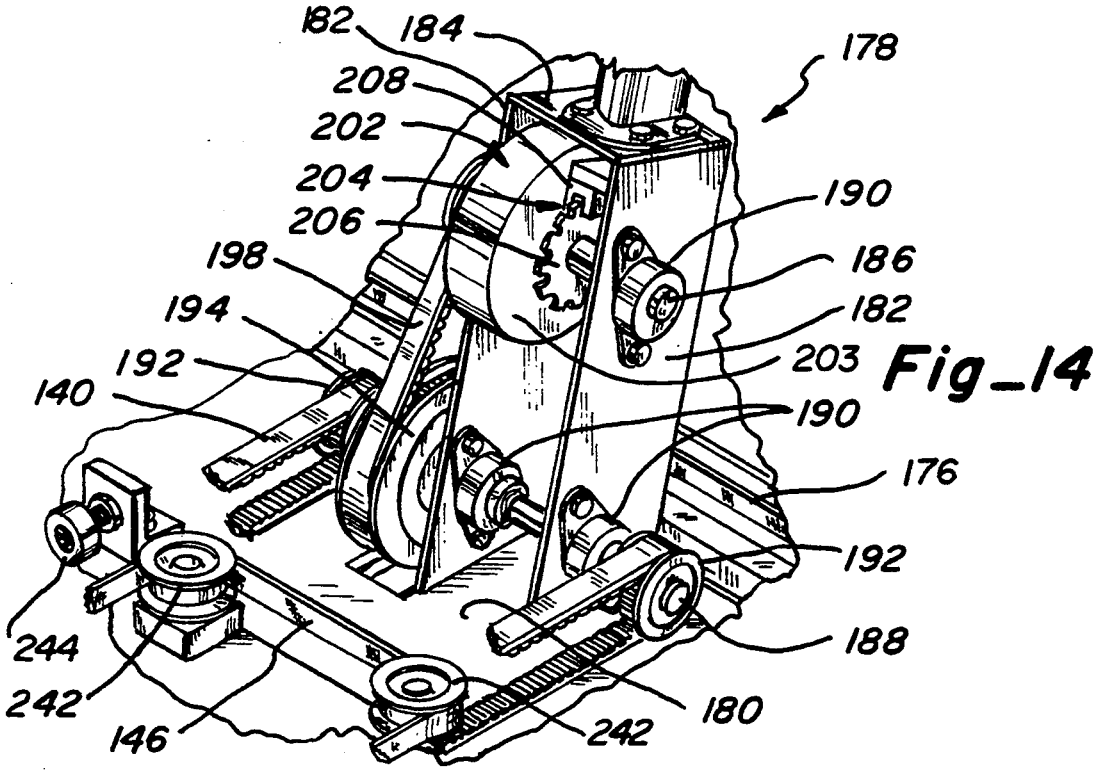
FIG. 14 is a fragmentary isometric view with parts removed of the portion of the apparatus shown in FIG. 13.

The foot-supporting members 40 define foot trolleys as best illustrated in FIGS. 4 and 8 through 12, and are adapted to roll along and between the central channel extrusion and the adjacent intermediate channel extrusions. Each foot trolley as best seen in FIGS. 9 and 10 has an inverted U-shaped main body 118 with an upper protrusion 120 of T-shaped cross section integrally connected to the top of the main body. A rearward plate extension 122 protrudes from a top wall 124 of the main body to mount operative components of the control system. Each foot trolley has a front and a rear transverse axle 126 that supports on opposite ends vertically oriented support rollers 128 which are adapted to be received for rolling movement along the vertical tracks 64 and 84 of the associated central and intermediate channel extrusions respectfully. Horizontally oriented guide rollers 130 are rotatably suspended from the outer side wall 132 of the main body 118 at the front and rear end of the trolley. The guide rollers 130 are adapted to roll along the horizontal track 94 defined in each intermediate channel extrusion **42*i*. A molded rubber foot receiving pad 134 (FIG. 8) is secured to the top surface of the upper T-shaped protrusion 120** with suitable fasteners and is adapted to receive the foot of a user of the apparatus.

As is best appreciated by reference to FIG. 9, a neck 136 of the upper T-shaped protrusion 120 extends through the slot 58 defined between adjacent top walls segments of the central and associated intermediate channel extrusions. In this manner, the main body 118 of each trolley 40 is substantially confined between the central and intermediate channel extrusions while the foot-receiving pad 134 is disposed above the top wall segments of the extrusions. It can be appreciated that the vertical and horizontal rollers on each foot trolley smoothly guide movement of the trolleys along the length of the extrusions and also resist vertical and horizontal forces applied to the foot trolleys to stabilize their movement within the framework.

The rearward plate extension 122 from the main body 118 of each foot trolley has an anchor plate 138 adjustably suspended therefrom which is adapted to receive and anchor one end of an associated horizontally oriented timing drive belt 140. In addition, a horizontally disposed idler pulley 142 (FIG. 11) is suspended from a rear location on the main body of the foot trolley so as to be downwardly spaced from the anchor plate 138. The idler pulley serves a purpose to be described later.

Each foot trolley 40 has a clamp bracket 144 (FIGS. 9, 11 and 12) at its forward end secured to the undersurface of the main body 118. The clamp bracket anchors the opposite end of the horizontally oriented timing drive belt 140 associated with the foot trolley and one end of a vertically oriented safety belt 146. The opposite end of the safety belt is secured to the opposite foot trolley in an identical fashion. The disposition of the timing drive belts and the safety belt within the framework will be described later.

Figure 3:
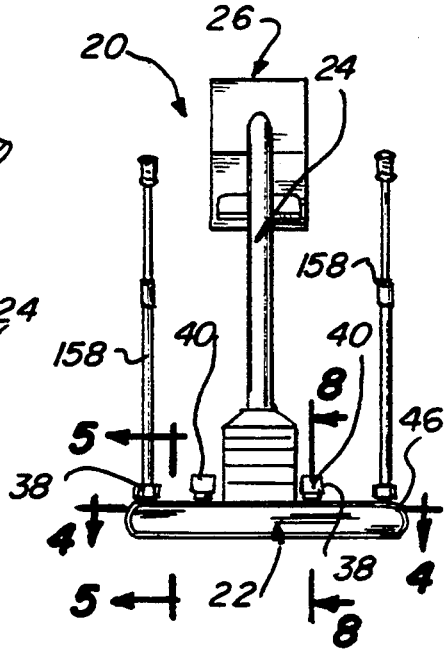
FIG. 3 is a front elevational view of the apparatus of FIG. 1.
Figure 5:
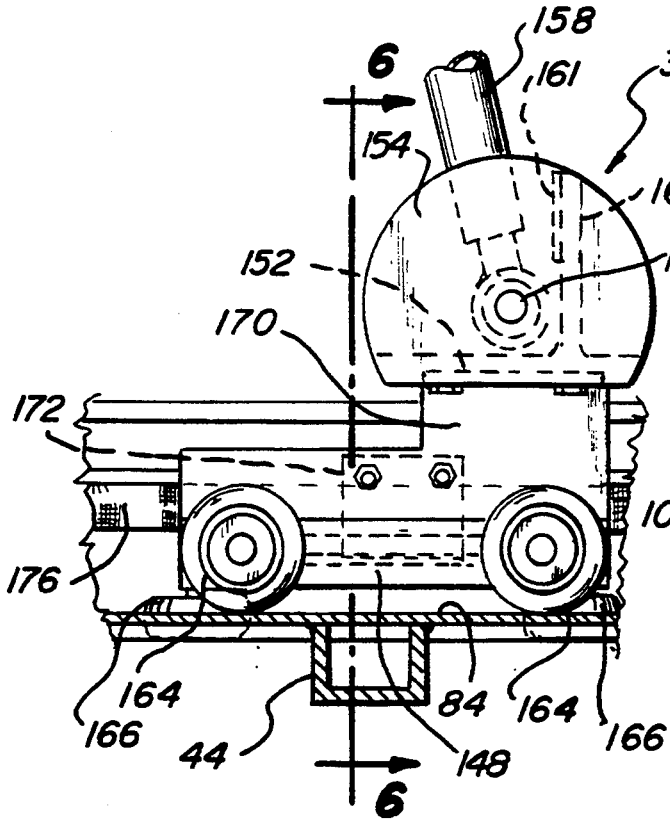
FIG. 5 is an enlarged fragmentary section taken along line 5—5 of FIG. 3.
Figure 6:
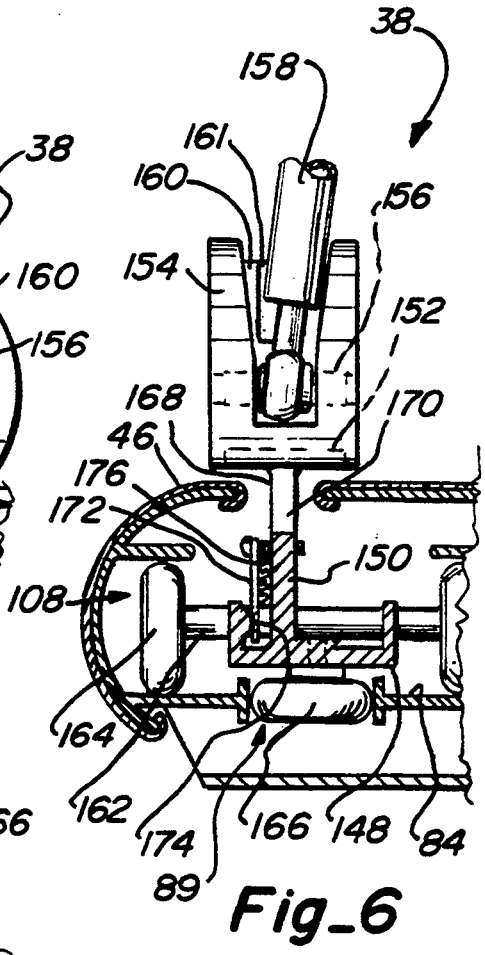
FIG. 6 is a fragmentary section taken along line 6—6 of FIG. 5.
Figure 7:
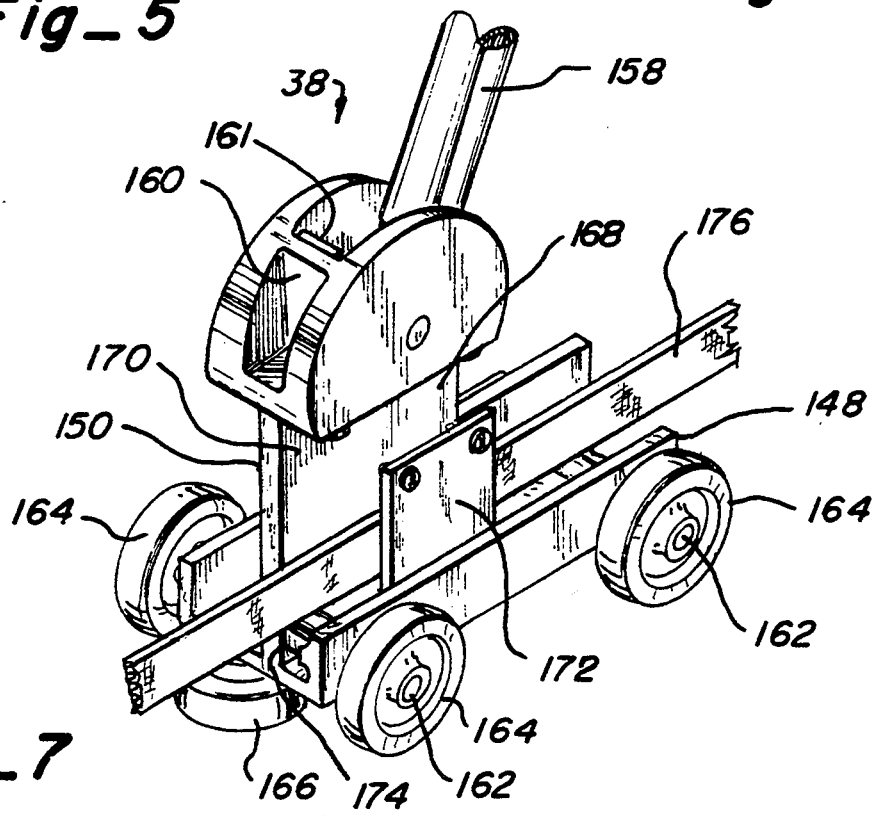
FIG. 7 is a fragmentary isometric view of the trolley for a hand-engaging member.

The hand-engaging members 38, best seen in FIGS. 5 through 7, define hand trolleys adapted for rolling movement between the outer and intermediate channel extrusions in a manner similar to that of the foot trolleys 40. Each hand trolley has a main body 148 of substantially U-shaped cross section with a vertical extension 150 of T-shaped cross section integrally protruding upwardly therefrom. The extension 150 is laterally offset from a centered position as best seen in FIG. 6. A horizontal top plate 152 on the extension 150 supports an arcuate clevis 154 of generally U-shaped cross section which pivotally supports through a transverse lock pin 156 the lower end of a simulated ski pole 158. The ski pole, as is probably best illustrated in FIGS. 1 through 3, is adjustable in length to accommodate various user heights and has a grip on the upper end to facilitate use of the apparatus. A cross web 160 on the clevis 154 limits pivotal movement of the ski pole in a rearward direction and a magnet 161 secured to the web selectively prevents movement of the ski pole in a forward direction for safety and convenience.

The main body 148 of each hand trolley supports a pair of front and rear transverse axles 162 which have vertically oriented rotatable support rollers 164 on the terminal ends thereof and which are adapted to ride within and be confined by the vertical tracks 108 and 84 in the outer and intermediate channel extrusions respectively. Front and rear horizontally oriented guide rollers 166 are rotatably suspended from the bottom of the main body 148 and are adapted to ride in and be confined by the lower horizontal track 89 between the outer and intermediate channel extrusions. As with the foot trolleys, the hand trolleys thereby have mutually perpendicular rollers that provide support in both vertical and horizontal directions so that all force components placed on the members during use of the apparatus are suitably reacted against to provide a smooth rolling movement of the members between the associated channel extrusions.

The outer side 168 of the vertical leg 170 of the extension 150 has a clamp plate 172 adjustably secured thereto. The clamp plate reacts against a bead 174 on the main body 148 to secure a main flat synchronizing belt 176 to the hand trolley as the belt extends through the hand trolley by gripping the belt between the clamp plate and the vertical leg 170. As will be appreciated with the description of the control system hereafter, the main flat synchronizing belt 176 is also secured in an identical fashion to the opposite hand trolley.

The upright standard 24 at the forward end of the apparatus is supported by and securely connected to a drive module 178. The drive module is mounted on a front base plate 180 positioned immediately forwardly of the front terminal end of the central channel extrusion **42*c*. As mentioned previously, the central channel extrusion terminates short of the forward end of the apparatus thereby defining a space for working components of the apparatus and it is in this space that the drive module is mounted. As best seen in FIG. 8, the front base plate 180 of the drive module is bolted or otherwise secured to cross frame members 44** extending transversely of the apparatus above front and rear edges of the base plate.

The drive module which is probably best illustrated in FIGS. 4, 8, 13 and 14 has left and right forwardly inclined vertical plate portions 182 secured to the base plate which define a space therebetween. A top plate 184 interconnects the upper edges of the vertical plate portions and forms an anchor platform for the upright standard 24 which is bolted to and extends upwardly from the top plate. The vertical plate portions 182 support upper and lower horizontal drive shafts 186 and 188 respectively and include bearing members 190 for rotatably supporting the shafts.

The lower drive shaft lee is in horizontal alignment with the foot trolleys 40 and has drive pulleys 192 with built-in one-way drive clutches mounted on opposite ends thereof to receive a timing drive belt 140 that is associated therewith. The one-way drive clutches thereby unidirectionally rotate the lower drive shaft 188.

The lower drive shaft also supports at a location immediately left of the left vertical plate portion 182 a relatively large diameter drive pulley 194 which is fixed to the lower drive shaft and driven only unidirectionally due to the unidirectional rotation of the lower drive shaft. As will be appreciated, as the foot-supporting members 40 are reciprocated along their associated channel extrusions 42, the timing drive belts 140 associated therewith move in opposite directions relative to each other but through the one-way drive pulleys 192 and the lower drive shaft 188, rotate the large drive pulley 194 in one direction.

The upper drive shaft 186 is journaled in the vertical plate portions 182 while protruding through the left plate a sufficient distance to accommodate the mounting of a drive pulley 196 with a one-way clutch built therein which is aligned with the relatively large drive pulley 194 on the lower drive shaft. A timing belt 198 interconnects the relatively large drive pulley with the one-way drive pulley 196 to impart unidirectional rotation to the upper drive shaft at a greater rpm than the rpm of the lower drive shaft. A belt tensioner pulley 200 is mounted in alignment with the large drive pulley 194 on the left vertical plate portion to maintain a desired tension in the timing belt. It will be appreciated, however, that due to the one-way drive pulley 196 being disposed on the upper drive shaft 186 along with an inertial weight on the upper drive shaft to be described later, the somewhat intermittent unidirectional rotation of the lower drive shaft 188 is transformed into a substantially uniform rotation of the upper drive shaft.

Positioned between the two vertical plate portions on the upper drive shaft, is a braking system 202 that is adapted to selectively resist rotation of the upper drive shaft 186 and in so doing provide selective resistance to operation of the apparatus to obtain variable exercise levels for the user of the apparatus. The manner in which this is accomplished will become more clear with the description of the control system that follows but the braking system in the disclosed embodiment is a conventional eddy-current brake that is electromagnetically operated to selectively resist movement of the upper drive shaft. The braking system is operably connected with suitable controls on the display device 26 so that the resistance provided by the braking system can be selectively adjusted. Brakes of this type can be obtained from Stromag, Inc. of Centerville, Ohio. The braking system being utilized includes an outer inertial rotor 203 to further encourage a continuous rotation of the upper drive shaft as mentioned previously.

Immediately adjacent to the braking system and also between the upright vertical plate portions, the upper shaft 186 carries a transducer 204 designed to convert the mechanical rotational movement of the upper drive shaft to an electronic signal which can be conventionally digitized for display on the display device 26 on the front upright standard 24. The transducer 204 is a standard item that includes an optical interrupter disk 206 having protruding teeth along its perimeter which pass through an optical sensor 208 so that the optical sensor is alternately interrupted by the teeth. The sensor counts on and off cycles per unit of time and the display device 26 converts the signals to a digital readout for human comprehension.

For purposes of the present disclosure, the control system is defined to include not only the three previously mentioned belts but also each of the pulleys on the framework, the clutches and all other components disposed in the drive module. In order to better understand the control system, a description of the operative interconnections and dispositions of each of the three belts follows. The main flat synchronizing belt 176 is operatively anchored at its opposite ends to the framework of the apparatus. The system utilized for anchoring the belt 176 is a somewhat resilient system 210 which includes front and rear transverse brackets 212 and 214 respectively best seen in FIGS. 4, 8 and 17 which are secured to the rear base plate 30 that also supports the restraining system 28.

The front and rear transverse brackets 212 and 214 respectively are each of L-shaped transverse cross section with the front bracket 212 being fixedly secured to the rear base plate 30 and the rear bracket 214 being slidably connected to the rear base plate by three threaded vertical shafts 216 projecting upwardly from the rear base plate and being slidably received in three elongated slots 218 provided in a lower horizontal leg of the rear transverse bracket. Suitable fasteners are threaded onto the shafts 216 in a manner to secure the rear transverse bracket to the rear base plate. Prior to being secured to the rear base plate, however, the bracket can be moved longitudinally of the apparatus to pre-tension the synchronizing belt. A pair of coil spring systems 220 interconnect vertical legs 222 and 224 of the front and rear transverse brackets respectively with the systems being adapted to assist in obtaining a desired tension in the synchronizing belt. The rear transverse bracket has a pair of forwardly projecting ears 226 integrally formed on opposite ends of the vertical leg 224 of the bracket with clamp plates 228 on external surfaces thereof adapted to secure the opposite ends of the main flat synchronizing drive belt 176.

Figure 17:
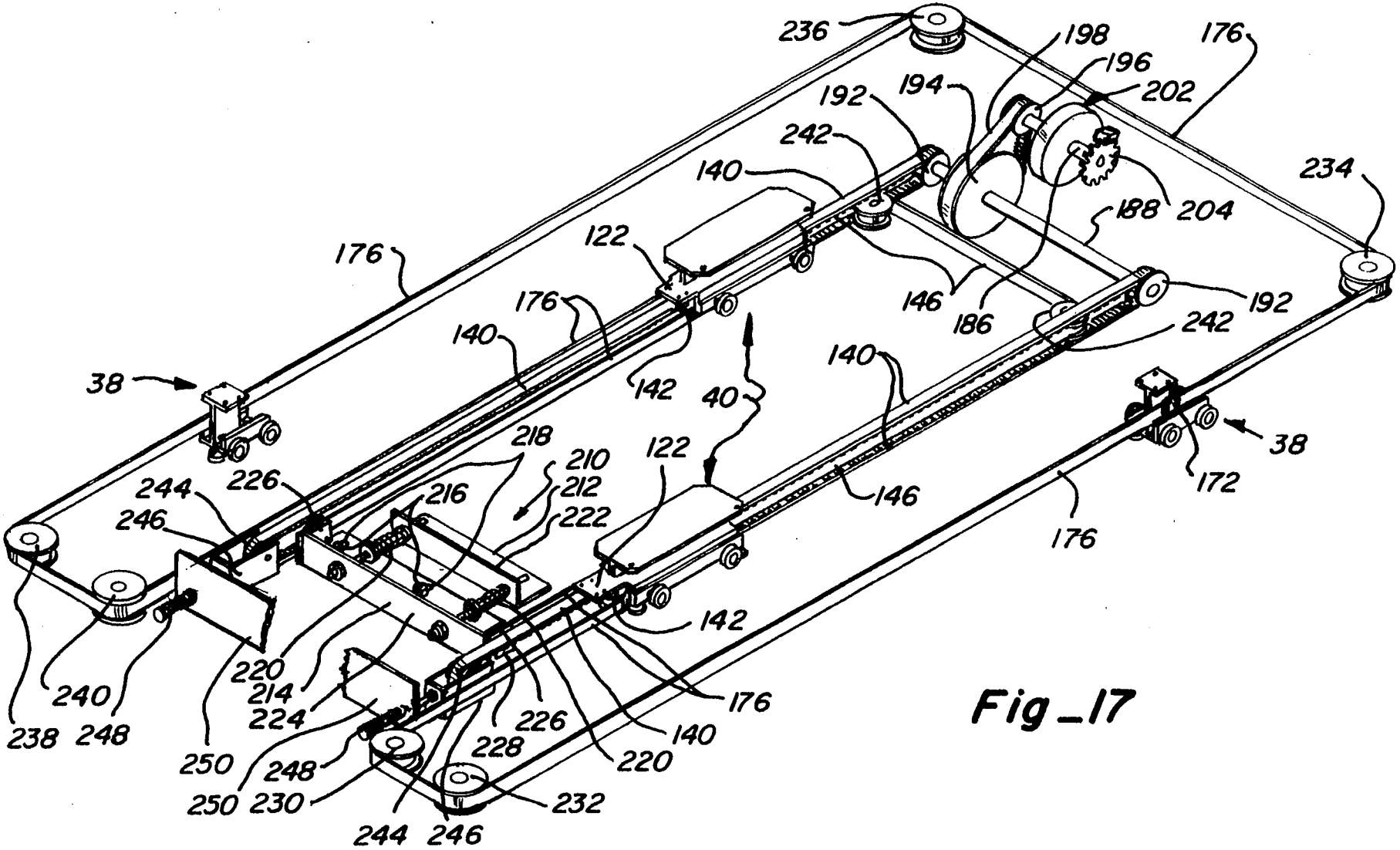
FIG. 17 is a diagrammatic isometric view showing the control system of the present invention in combination with the foot-supporting members and hand-engaging members.

Tracing the main flat synchronizing belt 176 from its connection at one end to the right side of the rear transverse bracket 214, it can be seen in either FIGS. 4 or 17 to extend forwardly and is passed around the idler pulley 142 on the rear of the right foot support member 40 from which it subsequently returns to the rear of the apparatus and extends around the innermost one 230 of a right side pair of laterally adjacent idler pulleys which are secured to the framework by attachment to a cross frame member 44 directly therebeneath. From the innermost idler pulley 230, the main flat synchronizing belt extends to and around the outwardmost idler pulley at the rear of the apparatus. After passing around the outwardmost idler pulley 232, the main flat synchronizing belt again extends forwardly and passes through the right hand-engaging member 38 to which it is attached by the clamp plate 172. When the belt reaches the front of the apparatus, it is passed around a right front idler pulley 234 which is also secured to the framework through an underlying cross frame member 44 and then extends across the front of the machine where it extends around a left front idler pulley 236 also mounted to a cross frame member. After extending around the left front idler pulley 236, the main flat synchronizing belt extends rearwardly through the left hand-engaging member 38 to which it is securely attached by the clamp plate 172 and upon reaching the rear of the apparatus, passes around the outwardmost one 238 of a left side pair of idler pulleys which are mounted in transverse relationship to the framework also by attachment to a cross frame member 44. From the outwardmost idler pulley, the belt passes around an inwardmost idler pulley 240 of the left side pair and subsequently again extends forwardly and is passed around the idler pulley 142 on the rear of the left foot supporting member 40. Thereafter the main flat synchronizing belt reverses direction and extends rearwardly where it is attached to the other end of the rear transverse bracket 214.

The safety belt 146 is a flat belt and as mentioned previously is anchored at opposite ends to each of the foot-supporting members 40. The safety belt extends forwardly from each foot-supporting platform and around a pair of idler pulleys 242 at the front end of the apparatus which are laterally spaced from each other in alignment with associated foot-supporting members. The idler pulleys 242 are positioned rearwardly of the idler pulleys 234 and 236 on the front of the apparatus associated with the main flat synchronizing belt 176. This allows clearance for the two belts to extend in parallel adjacent relationship with each other across the front of the apparatus. The safety belt is mainly provided to establish a positive link between the foot-supporting members to assure that when one foot-supporting member moves rearwardly, the other will move forwardly but is also provided to prevent injury or the like to the user of the apparatus in the event a timing drive belt 140 were to break.

It will be seen from the relationship of the main flat synchronizing belt 176 and the safety and coordinating belt 146 with the foot-supporting members 40 and hand-engaging members 38 that the members are operatively interconnected such that the foot-supporting members will move reciprocally in opposite directions while the hand-engaging members are also moving reciprocally in opposite directions at twice the speed of movement of the foot-supporting members. It will also be appreciated that the right hand-engaging member moves in an opposite direction to the right foot-supporting member which is also true of the left hand-engaging member and left foot-supporting member. Also, bumper stops 244 (FIGS. 4 and 14) are mounted on the front base plate 180 in alignment with the foot-supporting members to limit the forward movement of the foot-supporting members.

As mentioned previously, there is a timing drive belt 140 associated with each of the foot-supporting platforms 40 and they are anchored at opposite ends to an associated foot-supporting platform. Also as mentioned previously, as a timing drive belt extends forwardly from its associated foot-supporting platform, it passes around an associated drive pulley 192 on the lower drive shaft 188 to impart unidirectional motion to the lower drive shaft. After passing around the one-way drive pulley 192, the timing drive belt extends rearwardly and passes beneath the associated foot trolley through the notches 114 formed in the cross frame members 44 and through the space between the lateral edge 60 of bottom wall 48 and rib 90 of bottom wall 70 of the central extrusion and an intermediate extrusion respectively. The timing drive belt then extends around an aligned idler pulley 244 mounted on a bracket 246 that is resiliently connected through a coil spring system 248 to a web extension 250 (FIGS. 4 and 8) from the vertical segment 32 of the restraining system. After passing around the idler pulley 244, the belt again extends forwardly and is anchored to the rear of the associated foot-supporting member in the manner described previously. As can be appreciated, the sole purpose for the timing drive belts associated with the foot-supporting members is to impart unitary rotational movement to the lower drive shaft which in turn transfers that unitary rotational movement to the upper drive shaft which includes the braking system and the optical transducer.

The apparatus of the present invention has numerous advantages in its simplicity and ability to not only coordinate the hand and foot movements of a user of the apparatus but to do so in a manner that is non-damaging to the joints of the user and with a control mechanism that is very simple in structure and operation. As may be appreciated with prior art systems, the control system can become very complex thereby establishing a significant amount of mass and friction that needs to be overcome to even operate the system. The system of the present invention has minimal mass and minimal friction while achieving very desirable results from a user standpoint.

Further, due to the unique mounting of the foot-supporting platforms and hand-engaging members with mutually perpendicular rollers, the longevity of the device is optimized by minimizing stress which might otherwise be placed on the trolleys by variously directed forces which have both vertical and horizontal components.

Although the present invention has been described with a certain degree of particularity, it is understood that the present disclosure has been made by way of example and changes in detail or structure may be made without departing from the spirit of the invention, as defined in the appended claims.

We claim:

1. A quadrilateral exercise apparatus comprising, in combination, a frame having a front and rear end, a pair of foot-supporting members slidably mounted in said frame for linear reciprocating movement between said ends, a pair of hand-engaging members slidably mounted on said frame for linear reciprocating movement in parallel relationship with the movement of said foot-supporting members, each of said hand-engaging members being associated with and adjacent to a foot-supporting member, an elongated flexible synchronizing element affixed to and interconnecting each of said foot-supporting members and hand-engaging members such that said foot-supporting members move in opposite directions relative to each other and said hand-engaging members move in a direction opposite to that of the associated foot-supporting member, an elongated flexible safety element having opposite ends affixed to said foot-supporting members, said elongated safety element interconnecting said foot-supporting members whereby rearward movement of one foot-supporting member requires forward movement of the other foot-supporting member, a brake, a pair of one-way clutches operatively connected to said brake, each said clutch unidirectionally activating said brake, and a pair of elongated, flexible drive elements each operatively connecting one of said foot-supporting members to one of said clutches to unidirectionally actuate said brake to alternately unidirectionally resist movement of said foot-supporting members.

2. The quadrilateral exercise apparatus of claim 1 further comprising a horizontal shaft operatively connecting said clutches and brake.

3. The quadrilateral exercise apparatus of claim 2 further including rotative speed measurement means operatively connected to said shaft and readout means on said frame operably associated with said speed measurement means, said readout means including conversion means for converting the rotative speed of said second drive shaft to a value indicative of a user's corresponding ground speed.

4. The quadrilateral exercise apparatus of claim 1 wherein said hand-engaging members move at approximately twice the speed of said foot-supporting members.

5. A quadrilateral exercise apparatus comprising in combination a frame having a front and rear end, a pair of foot-supporting members slidably mounted in said frame for linear reciprocating movement, a pair of hand-engaging members slidably mounted on said frame for linear reciprocating movement in parallel relationship with the movement of said foot-supporting members, each of said hand-engaging members being associated with and adjacent to a foot-supporting member, a main elongated synchronizing element interconnecting each of said foot-supporting members and hand-engaging members, a plurality of pulley members operably mounted on said frame and operably engaged with said main synchronizing element such that said foot-supporting members move in opposite directions relative to each other and said hand-engaging members move in a direction opposite to that of the associated foot-supporting member, a fixed length safety element having opposite ends, pulley means operably mounted on said frame around which said safety element passes, said ends of said safety element being secured to said foot-supporting members whereby rearward movement of either foot-supporting member will cause the other foot-supporting member to move forwardly, a brake, rotatable shaft means operably connected to said brake, and a pair of endless drive elements, each drive element of said pair being connected to one of said foot-supporting members and being operably interconnected with said rotatable shaft means to unidirectionally rotate said rotatable shaft means, said brake being operative to selectively resist movement of said foot-supporting members through said drive elements, said rotatable shaft means including a first and second drive shaft and an idler pulley mounted on said frame and operatively engaged with each drive element, a pair of one-way drive pulleys mounted on said first drive shaft, each of said drive elements extend around an associated idler pulley and an associated one-way drive pulley, each of said one-way drive pulleys being adapted to unidirectionally rotate said first drive shaft, said first drive shaft having a drive pulley mounted thereon adapted to unidirectionally rotate with said first drive shaft, said second drive shaft having a one-way drive pulley thereon, and a belt interconnecting said drive pulley and said one-way drive pulley on said second drive shaft.

6. The apparatus of claim 5 further including rotative speed measurement means operatively connected to said shaft and readout means on said frame operably associated with said speed measurement means, said readout means including conversion means for converting the rotative speed of said second drive shaft to a value indicative of a user's corresponding ground speed.

7. The quadrilateral exercise apparatus of claim 1 comprising a plurality of tracks on said extending longitudinally of said frame between said front and rear ends, said pair of foot-supporting members slidably mounted in said tracks on said frame for linear reciprocating longitudinal movement, said pair of hand-engaging members slidably mounted in said tracks on said frame for linear reciprocating movement in parallel relationship with the movement of said foot-supporting members, each of said members including a trolley having rollers engaged within associated tracks for longitudinal movement therein, said tracks confining said rollers against both vertical and lateral movement.

8. The quadrilateral exercise apparatus of claim 7 wherein each said trolley has at least one roller with a vertical axis and at least one roller with a horizontal axis.

9. The quadrilateral exercise apparatus of claim 7 further including means for diametrically confining said rollers within said tracks.

10. A quadrilateral exercise apparatus as defined in claim 1 further comprising an upright adjustable height column mounted on the rear end of said frame, a horizontal adjustable length cantilever beam mounted on the upper end of said column and extending from said column toward the front end of said frame, and a waist belt pivotally mounted on the forward end of said beam for vertical swinging movement thereon, said waist belt engaging a user of said apparatus for restraining forward and rearward movement of said user with respect to said frame while affording vertical movement of said user with respect to said frame.

* * * * *